United States Patent [19]

Sato

[11] 4,014,469

[45] Mar. 29, 1977

[54] NOZZLE OF GAS CUTTING TORCH

[76] Inventor: Kozo Sato, No. 7-12, Minami-3-chome, Yamamoto-cho, Yao, Osaka, Japan

[22] Filed: Nov. 17, 1975

[21] Appl. No.: 632,220

[52] U.S. Cl. ..... 239/404; 239/406; 239/424; 239/489

[51] Int. Cl.[2] ..... B05B 1/34

[58] Field of Search ..... 239/400, 404, 405, 406, 239/424, 424.5, 487, 488, 489

[56] References Cited

UNITED STATES PATENTS

| | | | |
|---|---|---|---|
| 1,195,298 | 8/1916 | Vuilleumier | 239/406 |
| 1,860,347 | 5/1932 | Crowe | 239/487 |
| 1,872,409 | 8/1932 | Coberly | 239/424 |
| 3,463,601 | 8/1969 | Childree | 239/406 X |
| 3,750,958 | 8/1973 | Haselmann | 239/424.5 X |

*Primary Examiner*—John J. Love
*Attorney, Agent, or Firm*—George B. Oujevolk

[57] ABSTRACT

A nozzle of a gas cutting torch includes an inner central passage for a cutting oxygen, and an outer annular passage for a preheating gas provided about the inner passage. A helical groove is provided in the outer passage so as to cause the swirling motion of the preheating gas passing along the outer passage. Another helical groove may be provided in the inner passsage for the cutting oxygen.

4 Claims, 4 Drawing Figures

NOZZLE OF GAS CUTTING TORCH

The present invention relates to a nozzle of a gas cutting torch.

A conventional nozzle for use with a gas cutting torch for a steel plate cutting operation comprises an axially extending first path for high pressure cutting oxygen, and a second annular path provided about said first path for preheating gas. As is usual in this kind of nozzle, the pressure of cutting oxygen or preheating gas is raised for the purpose of shortening the period of cutting operation. However this method has a technical limitation for the curtailment of operation period.

On the other hand, it is advantageous if two or more sheets of steel plates overlapping one on the other can be simultaneously cut. The attempt however has so far met with no success despite the strong requirement.

The greatest bottleneck in the gas cutting technique consists in the fact that the flame is rectilinearly spouted from the nozzle. In such the rectilinear type of flame, it easily disperses or radiates upon striking against a resistant object such as steel plate, thereby wasting the energy. On the other hand, in the case of a metal or solid cutting tool for use in boring, milling and the like, though the tool is worn to some extent by the friction between the tool and a workpiece, this does not cause immediate loss of tool performance. However in the case of fluid tool as of gas cutting torch, the flame easily disperses upon collision against a workpiece. Thus the fluid tool has a disadvantage in that the tool loses its performance much more easily than the case of solid tool. This disadvantage can hardly be surmounted however high the gas pressure may be raised. Thus there exists the limitation in the curtailment of the period of cutting operation.

As described above, the defect that the cutting energy is lowered by the dispersion of the flame on striking against a workpiece is derived from the fact that the flame is of rectilinear type.

An object of the invention is to obviate the above defect, and to provide a nozzle with improvement of the flame motion into swirling type.

Other objects and features of the invention will be apparent from the following description of the invention with reference to the accompanying drawings, in which.

Throughout the drawings, similar parts and elements are shown by the similar reference numerals.

Figure 1:
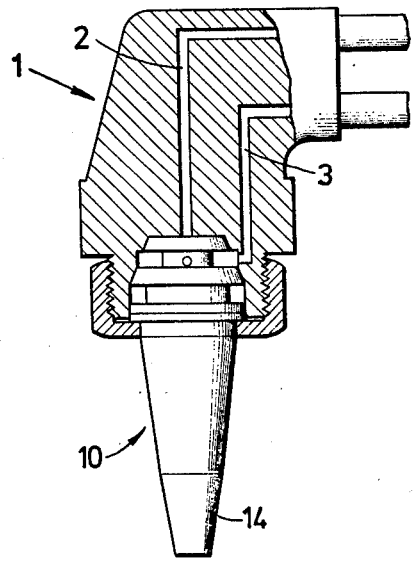
FIG. 1 is a side elevation, longitudinally sectioned in part, showing the state in which the nozzle of the invention is attached to a torch head.
Figure 2:
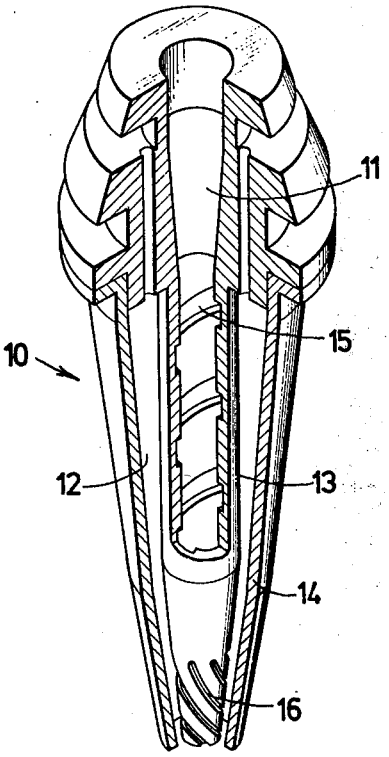
FIG. 2 is an enlarged perspective view, longitudinally sectioned in part, of the nozzle of the invention.

Referring now to FIGS. 1 and 2, a torch head generally indicated at 1 is attached at its end with a nozzle of the invention generally indicated at 10. Said torch head is provided with a supply channel 2 of high pressure cutting oxygen and a supply channel 3 of preheating gas such as acetylene gas mixed with oxygen, the former supply channel 2 communicating with an inner passage 11 extending through the center of the nozzle 10, the latter supply channel 3 communicating with an outer annular passage 12 provided about said inner passage 11. Said outer annular passage 12 is defined by a sleeve 14 which is mounted at a predetermined space about a tubular member 13 forming the inner passage 11.

In the inner periphery of said tubular member 13 is provided a helical groove 15, as shown is FIG. 2. Also in the outer periphery of said tubular member 13 is provided at its outer end portion a helical groove 16. The grooves 15 and 16 are for causing the fluids to swirl during passing along the passages 11 and 12 at a high speed, respectively. The helical grooves also permit the flux of the fluid to increase.

Figure 3:
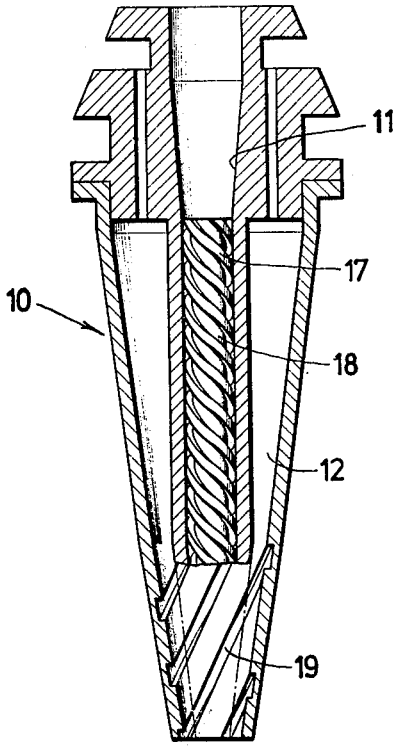
FIG. 3 is a longitudinal section showing another embodiment of the invention.

As shown in FIG. 3, instead of the helical groove 15, a rod 17 having a helical groove 18 may be fitted into the passage 11 in order to cause the swirling motion. Also a helical groove 19 may be provided in the inner periphery of the sleeve 14.

If desired, the groove 15 or rod 17 provided in the inner passage 11 may be omitted.

Figure 4:
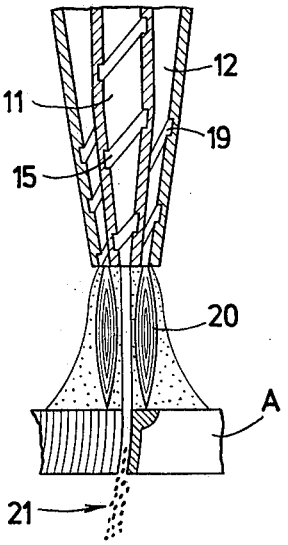
FIG. 4 is a diagram illustrating the operation of the nozzle of the invention.

The operation of the nozzle 10 of the invention will now be explained in reference to FIG. 4. The preheating gas ejected from the outer annular passage 12 heats a steel plate A at a high temperature in the form of preheating flame 20, while the high pressure cutting oxygen through the passage 11 is spouted against the heated portion to cause the steel plate A to burn (be oxidized), and simultaneously blows off the oxidized slag 21, thereby cutting the steel plate A. In the process, since the preheating gas passage 12 has the helical groove 16 or 19, the gas is caused to swirl during passing along the passage 12. As a result, the preheating flame 20 is also rotated thereby minimizing the dispersion of the flame and the loss of heating energy, unlike the case of the rectilinear flame. At the same tyme, similar swirling motion is given to the cutting oxygen by means of the helical groove 15 or 18 to minimize the dispersion of oxygen blowing against the steel plate A. Thus the nozzle of the invention enables the high efficiency heating and cutting operations.

As described above, the nozzle of the invention is adapted to cause the swirling motion to the preheating flame and thereby minimizes the loss of energy. The nozzle of the invention is therefore highly effective for the curtailment of the period of cutting operation as well as for the simultaneous cutting of the overlapping steel plates.

What is claimed is:

1. A nozzle of a gas cutting torch comprising an inner cutting gas passage tapered towards an outlet thereof with helical grooves extending to the outlet thereof, and a heating gas passage tapered towards an outlet thereof and annularly surrounding said inner passage, said heating gas passage having helical grooves extending to the outlet thereof.

2. For use with a torch head of a gas cutting torch having a central oxygen gas supply channel (2), a preheating gas channel (3) and a coupling end, a nozzle comprising:

a. an elongated nozzle body (10) with rear and front ends, said rear end having a frusto-conical portion with outer stepped portions for coupling to said coupling end;

b. a preheating passage defined in said portion coupled to said preheating gas channel (3) and an outer annular passage (12) defined by an inner sleeve (14) and an inner tubular member (13), said outer annular passage (12) being coupled to said preheating gas supply (3) by said preheating passage;

c. an inner passage defined by the inner wall of said inner tubular member (13) with inner and outer ends extending longitudinally through the center of said nozzle body (10), said inner end being located in said portion and being coupled to said oxygen supply channel (2), a helical groove (15) within said tubular member (13) and another helical groove (16) at the outer periphery and at the outer end of said tubular member, thereby causing the preheating flame formed at the front and outer end to rotate and the cutting oxygen to swirl to improve the efficiency of the burning.

3. A nozzle as claimed in claim 2, wherein said helical groove is defined within the inner wall of said inner tubular member.

4. A nozzle as claimed in claim 2, wherein said helical groove is defined by a rod within said inner tubular member said rod having an outer helix.

* * * * *